US008172548B2

(12) United States Patent
Doms et al.

(10) Patent No.: US 8,172,548 B2
(45) Date of Patent: May 8, 2012

(54) DRIVING AGENT VACUUM PUMP

(75) Inventors: Marco Doms, Nachenheim (DE); Jorg Muller, Buchholz (DE)

(73) Assignee: Bayer Technology Service GmbH, Leverkusen (DE)

( * ) Notice: Subject to any disclaimer, the term of this patent is extended or adjusted under 35 U.S.C. 154(b) by 340 days.

(21) Appl. No.: 12/486,300

(22) Filed: Jun. 17, 2009

(65) Prior Publication Data

US 2009/0311110 A1 Dec. 17, 2009

Related U.S. Application Data

(63) Continuation-in-part of application No. 11/796,505, filed on Apr. 27, 2007, now abandoned.

(51) Int. Cl.
*F04F 9/00* (2006.01)

(52) U.S. Cl. ..... 417/152

(58) Field of Classification Search ..... 417/152–154
See application file for complete search history.

(56) References Cited

U.S. PATENT DOCUMENTS

| | | | | |
|---|---|---|---|---|
| 2,193,135 | A * | 3/1940 | Lamm | 417/152 |
| 3,245,609 | A * | 4/1966 | Rangabe | 417/152 |
| 4,845,360 | A * | 7/1989 | Landfors | 250/288 |
| 7,074,016 | B1 * | 7/2006 | Epstein et al. | 417/348 |
| 2002/0176802 | A1 | 11/2002 | Chung et al. | |
| 2004/0179946 | A1 | 9/2004 | Gianchandani et al. | |

FOREIGN PATENT DOCUMENTS

| | | | |
|---|---|---|---|
| DE | 20120138 | U1 | 2/2002 |
| EP | 0476157 | A | 3/1992 |

OTHER PUBLICATIONS

Ye et al "A Vaporizing Water Micro-Thruster" IEEE, 2000, pp. 74-79.
Nguyen et al "MEMS-Micropumps: A Review" Journal of Fluids Engineering, vol. 124, Jun. 2002, pp. 384-392.
Mastrangelo et al "Microfabricated Thermal Absolute-Pressure Sensor with On-Chip Digital Front-End Processor" IEEE Journal of Solid-State Circuits, vol. 26, No. 12, Dec. 1991, pp. 1998-2007.
Young, Robert M. "Analysis of a Micromachine Based Vacuum Pump on a Chip Actuated by the Thermal Transpiration Effect" Journal of Vacuum Science and Technology, vol. 17, Iss. 2, Mar./Apr. 1999, pp. 280-287.
Hobson et al "Review of Pumping by Thermal Molecular Pressure" Journal of Vacuum Science and Technology, vol. 18, Iss. 4, Jul./Aug. 2000, pp. 1758-1765.
Woias et al "Micro-pumps—Summarizing the First Two Decades" Proceedings of SPIE, vol. 4560, 2001, pp. 39-52.

(Continued)

*Primary Examiner* — Charles Freay
(74) *Attorney, Agent, or Firm* — Michaud-Kinney Group LLP

(57) ABSTRACT

A driving agent vacuum pump configured as a micropump is presented. The vacuum pump includes an evaporation chamber and a pumping chamber, which are separated by a jet arrangement. The jet arrangement includes a planar arrangement of at least one jet running vertically in depth between two plates. The two plates cover the evaporation chamber and the pumping chamber about the jet arrangement. An opening is provided in the pumping chamber above the jet arrangement for taking in an agent to be pumped. A second opening is provided for driving out a compressed gas below the jet arrangement. A connection is provided between the evaporation chamber and the pumping chamber through which a condensed driving agent is returned.

20 Claims, 5 Drawing Sheets

OTHER PUBLICATIONS

Rapp et al "LIGA Micropump for Gases and Liquids" Sensors and Actuators A, vol. 40, 1994, pp. 57-61.
Puers et al "The NanoPirani—an Extremely Miniaturized Pressure Sensor Fabricated by Focused Ion Beam Rapid Prototyping" Sensors and Actuators A, vol. 97-98, 2002, pp. 208-214.
Linnemann et al "A Self-Priming and Bubble-Tolerant Piezoelectric Silicon Micropump for Liquids and Gases" IEEE, 1998, pp. 532-537.
Weng et al "Micro-Pirani Vacuum Gauge" Review of Scientific Instruments, vol. 65, Iss. 2, Feb. 1994, pp. 492-499.
Vargo et al "Initial Results from the First MEMS Fabricated Thermal Transpiration-Driven Vacuum Pump" Rarefied Gas Dynamics: 22nd International Symposium, American Institute of Physics, 2001, pp. 502-509.
Schabmueller et al "Design and Fabrication of a Self-Aligning Gas/Liquid Micropump" Proceedings of SPIE, vol. 4177, 2000, pp. 282-290.
International Search Report dated Jan. 27, 2006.

* cited by examiner

100

100

DRIVING AGENT VACUUM PUMP

CROSS-REFERENCE TO RELATED APPLICATIONS

This application is a continuation-in-part of and claims priority to U.S. patent application Ser. No. 11/796,505, filed Apr. 27, 2007, now abandoned which is a continuation of International Patent Application No. PCT/EP2005/011660 filed on Oct. 31, 2005, which claims priority to German Patent Application No. 10 2004 053 006.8 filed on Oct. 29, 2004, subject matter of these patent documents is incorporated by reference herein in its entirety.

FIELD OF THE INVENTION

The invention concerns a miniaturized driving agent vacuum pump which uses preferably planar jet and pump wall geometries structured in keeping with microsystem technology and a suitable driving agent for vacuum creation. It is distinguished by simple manufacturability, small size and thereby good integration capability, for example into mobile systems, operation in a pressure region extending from about one atmosphere to several Pascal, higher suction efficiency and position independent functionality.

BACKGROUND OF THE INVENTION

Pumps for the transport of gases or for the creation of a vacuum exist in macroscopic scale in a number of type variations: displacement pumps, molecular pumps, sorption pumps, condensors, kyro pumps and driving agent pumps. Each of these varieties is suited for application within a specific pressure region; to create a pregiven pressure it can be necessary to operate a number of these pumps in series. The sizes of these customary vacuum pumps even in their smallest construction forms lie in the area of several tens of cubic centimeters. Therefore these pumps cannot be sensibly integrated into systems with microcomponents (for example, sensors). The application of, for example, miniaturized analysis devices, which for their function require a vacuum pressure or a constant gas flow is therefore closely coupled to the development of suitable micro gas pumps.

Micropumps use different physical or chemical principles to create a pumping effect (see, for example: Nam-Trung Nguyen, Xiaoyang Huang, Toh Kok Chuan, MEMS-Micropumps: A Review, Transactions of the ASME, Vol. 124 (June 2002), 384-392; P. Woias, Micropumps—summarizing the first two decades, Proc. SPIE, Vol. 4560 (2001), 39-52). Many of the systems are limited in their application to liquid medium; only a few suit themselves to the pumping of gases or to the creation of a vacuum.

A scaling of the customary pump principles with rotating parts for the displacement of gases is, because of the very small measures and the required rotational speeds for the creation of the displacement, nearly impossible. Most of the realized microvacuum pumps are based however on mechanically movable parts which considerably influence the long time stability of such systems, such as membranes, which through their movement create by way of different actuators the evoked pumping effect or in part require active or passive valves (see, for example: R. Rapp, W. K. Schomburg, D. Mass, J. Schulz, W. Stark, LIGA micropump for gases and liquids, Sens. Act. A. Vol. 40 (January 1994), 57-61; R. Linnemann, P. Wias-P, C. D. Senfft, J. A. Ditte rich, A self-priming and bubble-tolerant piezoelectric silicon micropump for liquids and gases, Proc. MEMS 1998 Heidelberg, 532-537; C. G. J. Schabmueller, M. Koch, A. G. R. Evans, A. Brunnschweiler, M. Kraft, Design and fabrication of a self-aligning gas/liquid micropump, Proc. SPIE-Int. Soc. Opt. Eng. (USA), Vol. 4177 (2000), 282-90).

Also capable of finding application are alternative pumps without mechanical parts and which are based on the principle of Knudsen compressors (thermal transpiration, thermal molecular pressure): between the two volumes at different temperatures which are connected to one another by way of a channel with a small cross sectional area, there exists a pressure difference which can be used for the creation of a pumping effect. Disadvantageous of this however is the relatively complicated construction and the high surface area requirement of such systems, indeed because of the low achievable compression ratio, many such pumps need to be driven in a series in order to create the desired suction performance and pressure difference (see, for example: R. M. Young, Analysis of a micromachine based vacuum pump on a chip actuated by thermal transpiration effect, J. Vac. Sci. Technol B 17(2), March/April 1999; J. P. Hobson, D. B. Salzman, Review of pumping by thermal molecular pressure, J. Vac. Sci. Technol. A 18(4), July/August 2000, S. E. Vargo, E. P. Muntz, Initial Results from the first MEMS fabricated thermal transpiration-driven vacuum pump, Rerefied Gas Dynamics: 22. Int. Symposium, 2001).

The use of the pumping principle forming the basis of the invention is not known in micropumps.

SUMMARY OF THE INVENTION

The micropump of the invention uses the functional principle of driving agent pumps having a rapidly flowing vapor phase or liquid driving agent expanded by moving through a jet. The gas particles in the container to be evacuated move into this driving agent stream and while in that stream receive impacts with the driving agent molecules giving them impulses in the pumping direction.

A special standing among driving medium pumps is taken by diffusion pumps, in the case of which, in contrast to other stream pumps, the mixing process of the driving agent with the gas to be evacuated does not occur in a turbulent boundary layer, but takes place by diffusion of the gas into the driving stream.

DETAILED DESCRIPTION OF PREFERRED EMBODIMENTS

Figure 1:
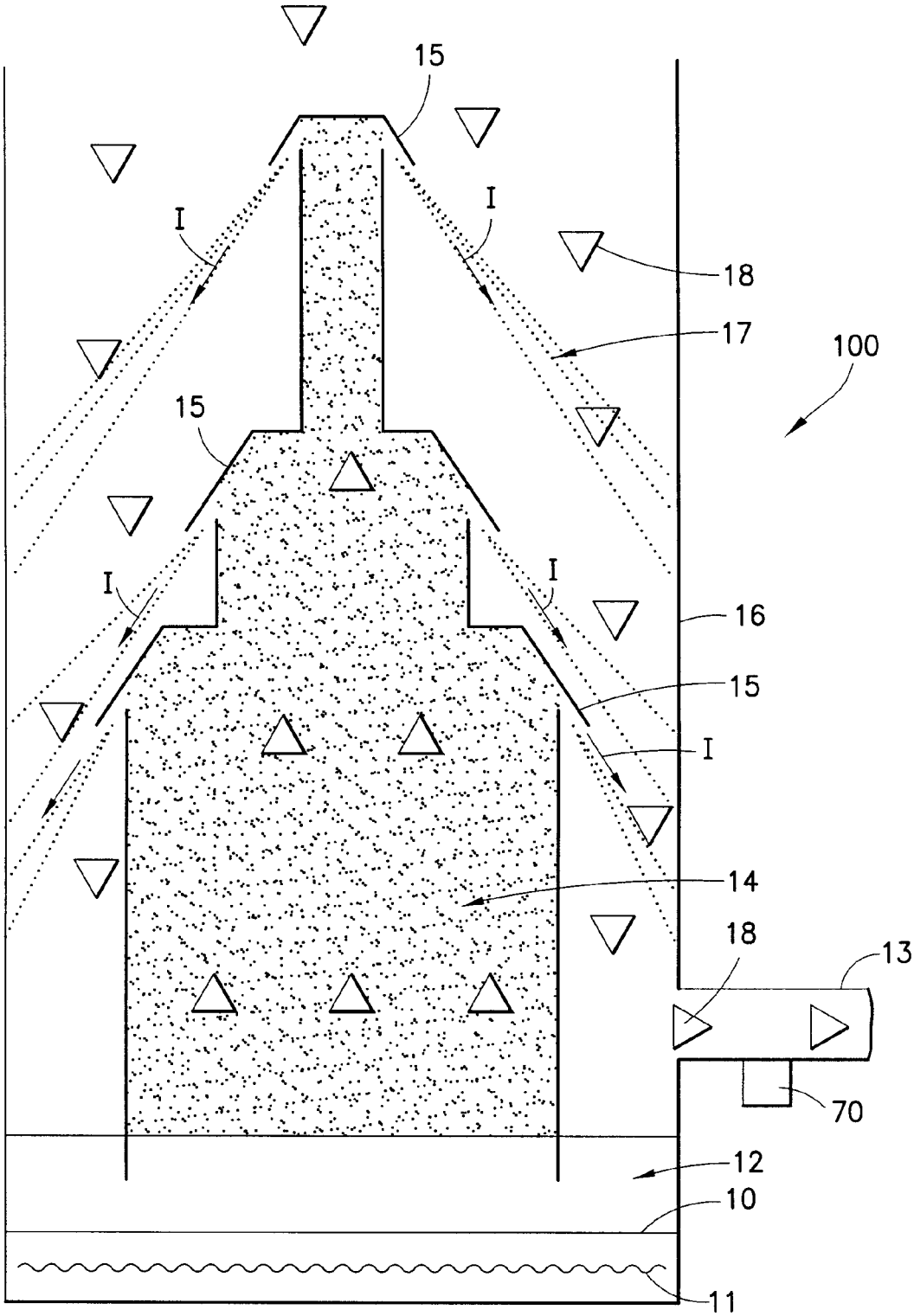
FIG. 1 is a cross-sectioned schematic illustration of a diffusion pump.

In FIG. 1, by way of example, the pumping principle for all driving agent pumps is illustrated by the aid of the construction of a diffusion pump 100: in a boiling space 12, by way of a heater 11, a suitable driving agent 10 (for example silicon oil) is heated; the resulting driving agent vapor 14, escapes as a driving agent vapor stream 17 at supersonic speed from jets 15, and transmits downwardly directed impulses (as indicated by arrows I) onto molecules of gas 18 to be evacuated. The driving agent vapor stream 17 condenses on cooled walls of pump body 16 and is returned again as the driving agent 10 in the boiling space 12 of a supply container.

The gas molecules 18 retain their impulses and moving with the vapor stream 17 reach a next lower jet stage. Below a last stage of the jets 15 the gas molecules 18 are taken away through a fore vacuum pipe 13, by means of a fore pump. The pumped away gas molecules 18 are further compressed from stage to stage, so that in the case of a constant mass flow its volume flow is correspondingly reduced. As shown in FIG. 1, the pump area between the jets 15 and the walls of the pump body 16 likewise diminishes accordingly from top to bottom, and the highest permissible pressure at the fore vacuum side is hereby increased (see, for example, Wutz, Adam, Walcher, Theorie und Praxis der Vakuumtechnik, Vieweg Verlag Braunschweig, 5. Edition (1992)).

As illustrated in FIGS. 1-6, one aspect of the invention lies in the conversion of this principle into a miniaturized form, preferably into a planar form adequate for microsystem techniques. Resulting from this utilization of miniaturization are further advantages. Here, in the case of a driving agent vacuum pump 100, consisting of an evaporating chamber 30 at high pressure and a pump chamber 40 at low pressure, separated by a jet arrangement 15. It is provided that the pumping effect is achieved by a flow of the driving agent vapor stream 17 (indicated by arrows I) at high speed through a preferably planar arrangement of jets 15 vertical in depth and located between two parallel plates 3*b*, 3*c* which close the chambers in the jet region. Further an opening 4 is provided in the pump chamber 40 above the jet arrangement 15 to draw in the medium (e.g., the driving agent 10) to be pumped and an opening 1 for the discharge of the compressed gas molecules 18 is provided below the jet arrangement 15. A planar jet arrangement 15 made of, for example, one or two Laval jets is used, for a purpose of expanding and accelerating selectively up to supersonic speed a liquid, gas or vapor phase driving agent under pressure. With this the jet stream 17 can achieve supersonic speed.

Because of its relatively small dimensions the driving agent vacuum pump 100 is usable at high pressures from about one atmosphere. By choice of the number of jets 15 arranged below one another and therewith a number of pressure steps, high compression ratios are achievable. Furthermore by the choice of suitable dimensions for the pump 100, of the driving agent 10 and of the evaporating temperature, the working pressure range can be varied widely.

A condensable medium or a gaseous medium is used as the driving agent 10. Further, as the driving agent 10, a liquid is used with in one implementation the liquid driving agent being evaporated by a heater 11 in the form of an electrically heated coil arranged in the evaporating chamber 30. Alternatively the driving agent 10 is already delivered to the evaporating chamber 30 in gaseous form.

The increased pressure of the driving agent 10 inside of the jet arrangement 15 can be achieved either by suitable measures outside of the micropump 100 or in the case of a vapor phase driving means by way of a heater and evaporator integrated in the pump so that a liquid can be achieved. The scaling of the measurements of the pump into the region of the free path of the gas molecules in the pressure region makes possible an operation in a pressure region of about one atmosphere down to several Pascal.

To achieve a high as possible pressure difference with only one microdriving agent pump several jet stages can be operated behind one another so that the evacuated gas in each stage is further compressed. A variation of the used driving agent and of the used evaporation temperature likewise makes possible an operation in different pressure regions.

To avoid a contamination of the jets 15 or of the jet delivery channels by small particles, a particle filter 20 can, for example, be integrated in the evaporation chamber 30. A similar filter can also be integrated into the delivery and discharge channels at the input and output of the evaporating chamber 30.

The driving agent vapor stream 17 ejected from the jets 15, which produces the actual pumping effect, in the case of the use of gases or liquids can be transported in a suitable way from the pump, and in the case of the use of a vapor phase driving agent it can be condensed on the pump walls 16 and, as the case may or may not be, can then be returned to the heater 11 integrated in the pump 100. There it is again vaporized (e.g., as the driving agent vapor 14) and it transitions into a driving agent circuit to make possible a closed system supplied outwardly with only energy for the heater 11.

To condense a gaseous driving medium the vacuum pump is provided with cooling of the outer wall 16 of the pump chamber. The condensation of the vapor phase driving agent (e.g., the driving agent vapor stream 17) can for example be accomplished by way of channels 22 in the walls 16 (FIG. 3) or by cooling ribs 70 (FIG. 5), which are filled with a liquid or a gas which removes heat from the sidewalls 16 used for the condensation; alternatively for this also Peltier elements 80 (FIG. 6) can be used.

Moreover, a connection is provided between the evaporating chamber 30 and the pump chamber 40 through which a condensed driving agent is returned and which connection at the same time serves as a pressure stage. A return of the condensed driving agent from the pump chamber 40 to the evaporating chamber 30 can, for example, be carried out by one or more capillary shaped channels 50 (FIG. 4) which is or are covered by a layer having an outer surface energy higher than that of the pump chamber 40. These measures make it possible to operate the micropump independently of its position.

For monitoring the pumping function in the pump chamber 40 at its input or output, or in the evaporating chamber 30 or in several or all positions a pressure measurement device or sensor 60 (FIGS. 3 and 4) is integrated with the pump 100. To monitor the operation of the micro driving agent pump and, as the case may be, to control or regulate it, several pressure sensors 60 can be integrated into the pump. These pressure sensors 60 can be applied to the pumping chamber 40 at the high vacuum side 6 and the fore vacuum side 2, as well as to the evaporating chamber 30 and by means of suitable switching technology measures can detect the pressure difference between the mentioned measuring points.

Because of their good reliability and applicability to different pressure regions, as pressure sensors 60 are offered, for example, a system based the Pirani principle which measures the pressure dependent heat conductibility of the surrounding medium (see, for example, Wutz, Adam, Walcher, Theorie und Praxis der Vakuumtechnik, Vieweg Verlag Braunschweig, 5. Edition (1992); Mastrangelo, Muller, Microfabricated Thermal Absolute-Pressure Sensor with on-Chip Digital Front-End Processor, IEEE J. Solid State Circuits, Vol. 65 No. 2 (1994), 492-499, Puers, Reyntjens, Bruyker, The NanoPirani—an extremely miniaturized pressure sensor fabricated by focused ion beam rapid prototyping, Sens. & Act. A. Vol. 97-98 (2002), 208-214). With this, there results the pressure measurement device 60 by way of a Pirani arrangement integrated into a microsystem technique.

Figure 2:
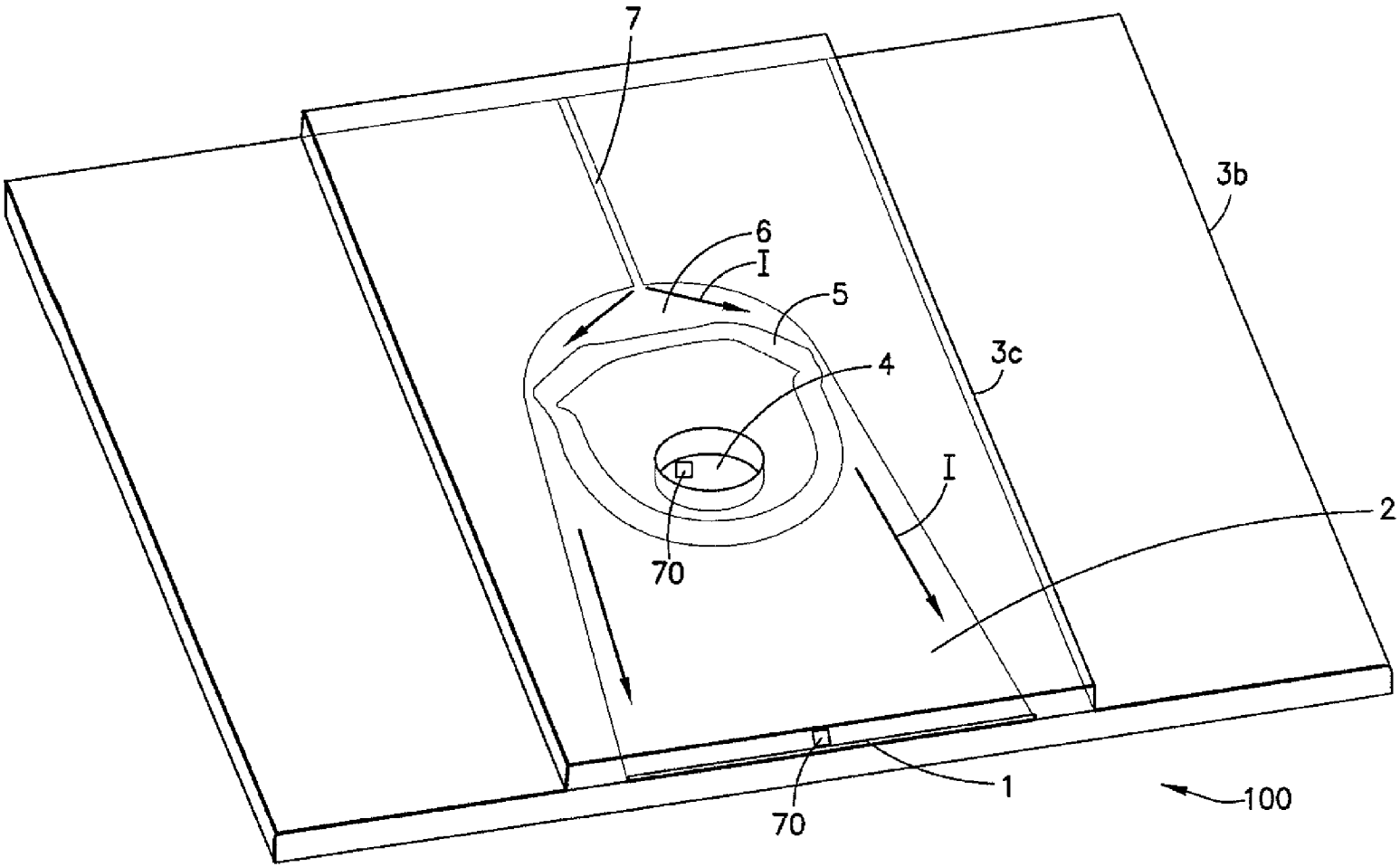
FIG. 2 is a schematic perspective view of a micro agent driving pump.
Figure 3:
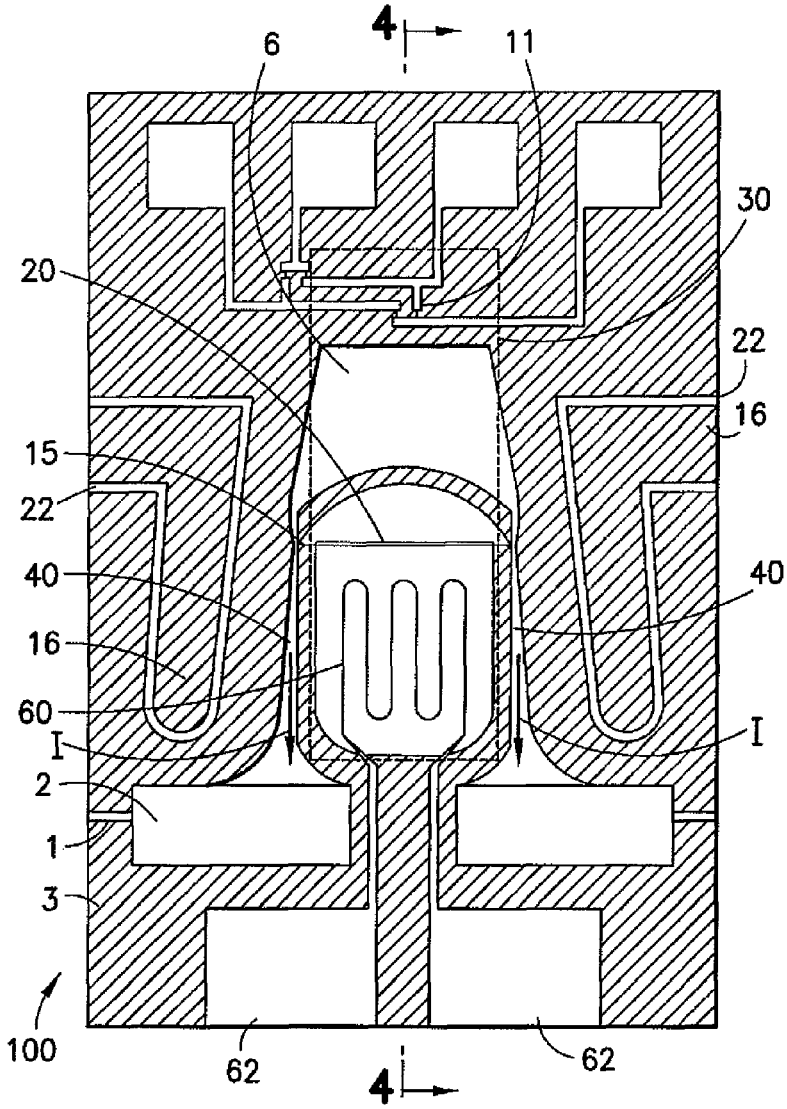
FIG. 3 is a partial plan view of the micro agent driving pump of FIG. 2 in accordance with one embodiment of the invention.
Figure 4:
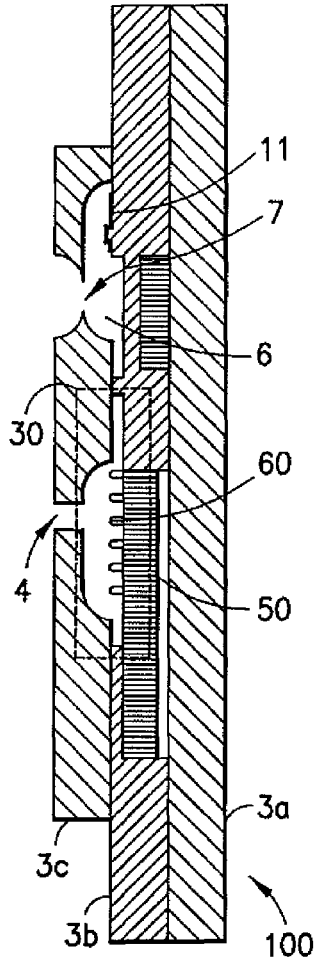
FIG. 4 is a cross-sectional view of the micro agent driving pump of FIG. 2 taken along line 4-4 of FIG. 3.
Figure 5:
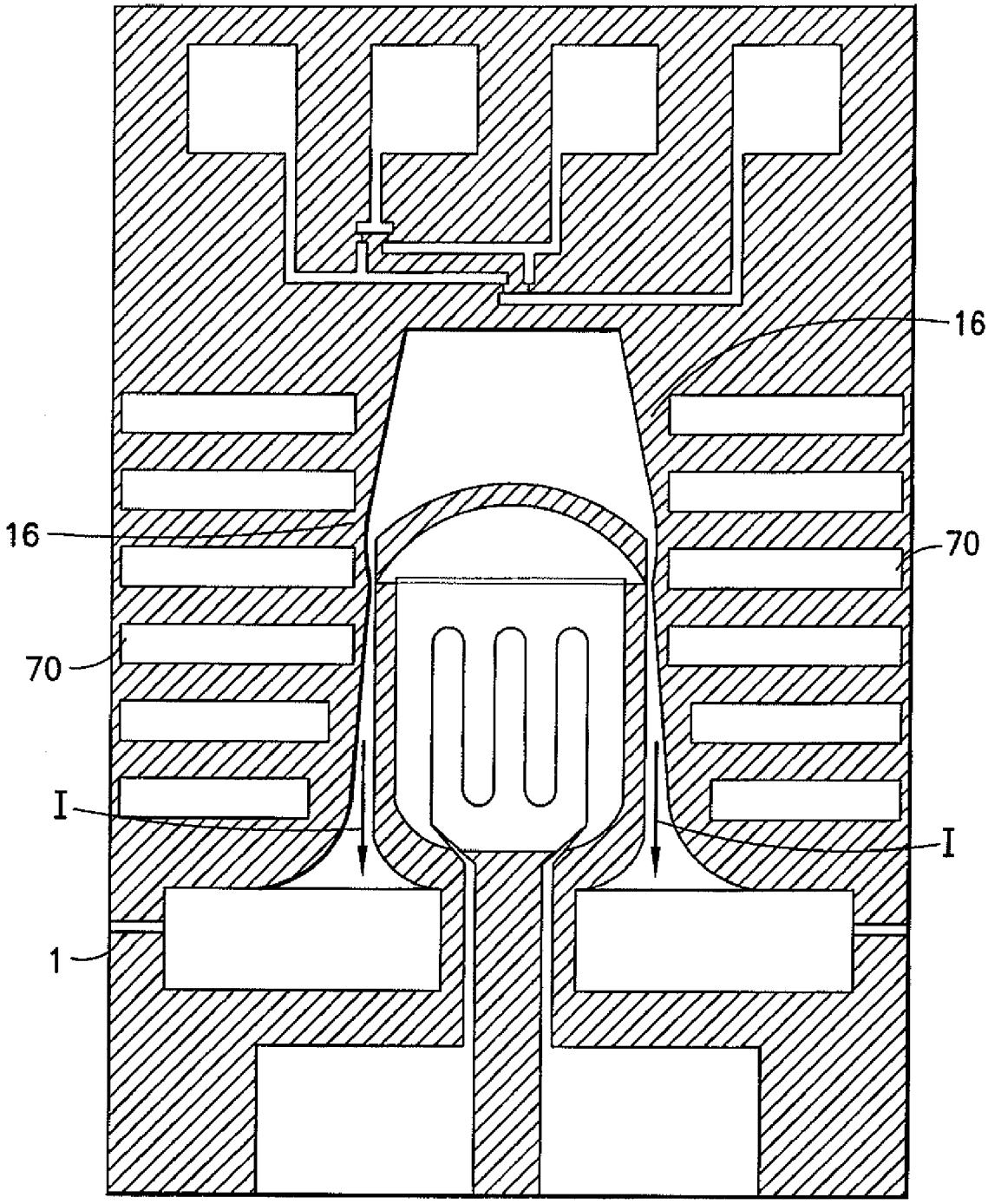
FIG. 5 is a partial plan view of the micro agent driving pump of FIG. 2 in accordance with another embodiment of the invention.
Figure 6:
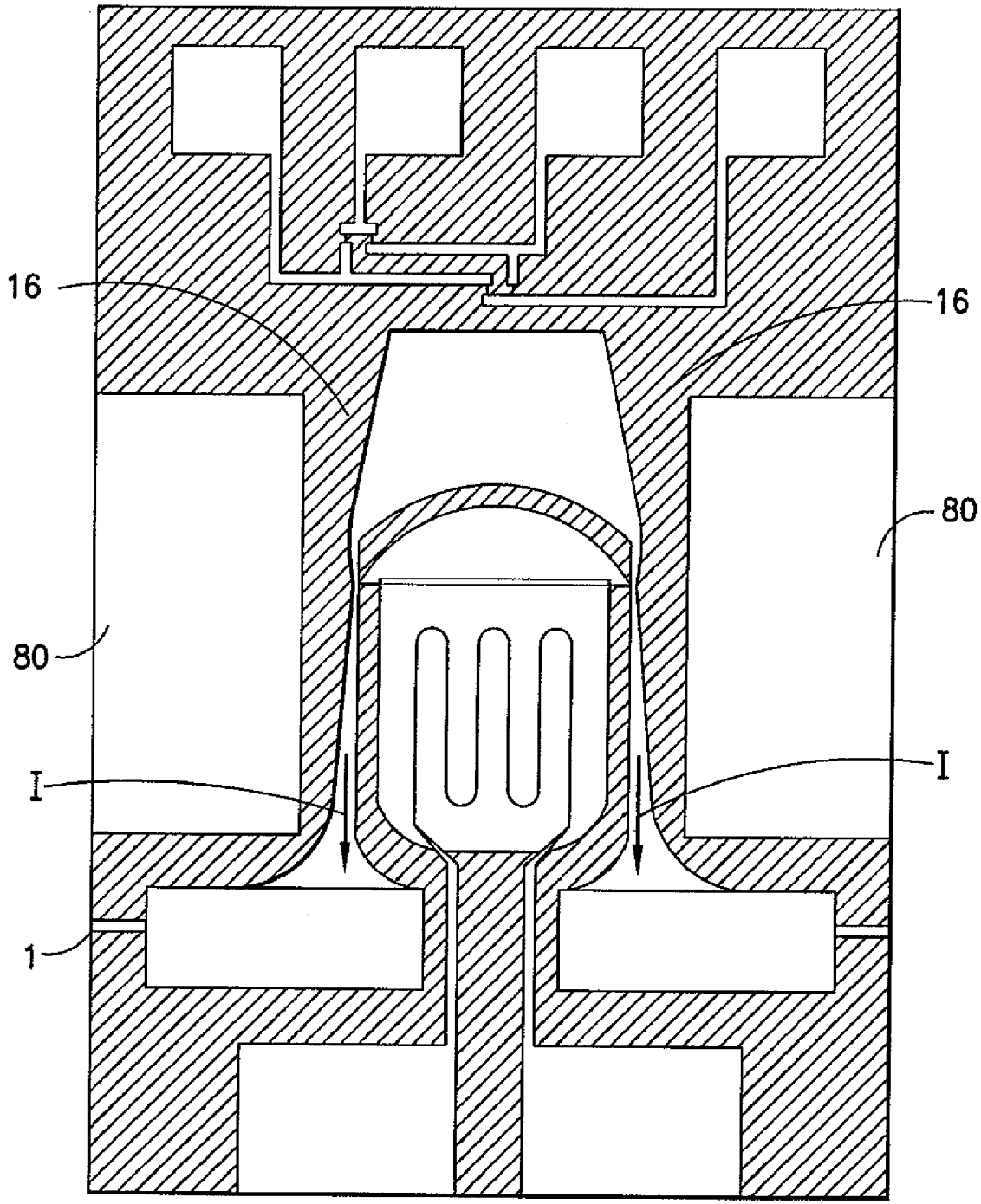
FIG. 6 is a partial plan view of the micro agent driving pump of FIG. 2 in accordance with still another embodiment of the invention.

Likewise for monitoring the pump 100 and for determining the suction performance a flow measurement device 70 based for example on a microsystem technique realized heating wire principle can be made at the suction intake pipe 4 (suction intake region) and/or possibly at the outlet 1 (FIG. 2).

The construction of the invention consists, for example, of three substrates of which the middle substrate contains the jet structures and it is distinguished by a high heat conductibility in order to facilitate the evaporation and condensation of a liquid driving agent. In one embodiment, a heat conductivity of a first substrate 3*a* is about 10 W/mK, a heat conductivity of a second substrate 3*b* is about 50 W/mK, and a heat conductivity of a third substrate 3*c* is about 10 W/mK.

In one implementation (FIG. 4), the driving agent vacuum pump 100 is made of three substrates 3*a*, 3*b*, 3*c*, the second or middle substrate 3*b* of which because of its good heat conductibility, mechanical and chemical stability as well as its structurabilty is preferably structured by way of anisotropic etching methods, is silicon and the substrates which close its two sides are preferably because of its low thermal conductivity made of anodically bonded glass.

Moreover, in this further implementation it is advantageous if the middle substrate 3*b* because of its good heat conduction is made of a galvanic metal structure, for example one made by UV-Liga technique, preferably galvanically washed on to a lower glass substrate and an upper glass substrate as a seal.

The two outer substrates 3*a*, 3*c* can contain one or more connection channels (e.g., channel 7 of FIG. 4) and, as the case may be, can serve as carriers for the integrated pressure or flow sensors and to close the evaporating chamber 30 and the pumping space. To serve as substrates silicon, preferably anisotropically structured boron silicate glass, can be used because of its good chemical and mechanical stability, and even galvanically finished metal structures and glass substrates or structures made by injection molding processes and polymer substrates can be used.

The driving agent vacuum pump 100 according to the invention is preferably closed by polymer substrates and also the jet arrangement 15 is created by, for example, an injection molded structure.

Because of its small size, the microdriving agent pump 100 has the following advantages: the pump 100 can be used for existing or in the future developed miniaturized systems, without necessarily increasing their construction shape.

Further, the micro driving agent pump 100 because of its small internal measurements can be used below a pressure of about one atmosphere and, according to its implementation with several jet stages 15 and a suitable driving agent 10, a pressure of down to several Pascal can be reached.

The system distinguishes itself by a simple way of being manufactured: in the first case the micro driving agent pump 100 consists of a silicon substrate structured by plasma etching methods and two anodically bonded boron silicate glass substrates as covers above and below the silicon substrate, one of which boron silicate glass substrates provides an access (e.g., the opening 4) from the outside into the evaporating chamber 30 for the external supply of a driving agent 10.

One such system is shown in FIGS. 2-6 by way of example: through the opening 4, a vapor phase driving agent 14 is delivered, which is expanded through the jets 5/15, and provides impulses I onto the gas molecules 18 delivered to the high vacuum side 6, through channel 7, connected to a volume. The driving agent condenses on the water cooled side walls 16 of the pump 3, and the evacuated gas molecules 18 move out of the micropump 100 through the vacuum fore side 2, and the outlet 1.

Typically the side length of the system has a value of about 15 mm.

What is claimed is:

1. A driving agent vacuum pump, comprising;

an evaporation chamber and a pumping chamber, which are separated by a jet arrangement; the jet arrangement including a planar arrangement of at least one jet running vertically in depth between two plates, with the two plates covering the evaporation chamber and the pumping chamber about the jet arrangement, and by an opening in the pumping chamber above the jet arrangement, for taking in an agent to be pumped and by an opening for driving out a compressed gas below the jet arrangement, wherein between the evaporation chamber and the pumping chamber is a connection through which a condensed driving agent is returned, and wherein the driving agent vacuum pump is configured as a micropump.

2. A driving agent vacuum pump according to claim 1, wherein at least one jet is formed as a Laval jet.

3. A driving agent vacuum pump according to claim 1, wherein the jet arrangement includes a plurality of jets.

4. A driving agent vacuum pump according to claim 1, wherein the driving agent is at least one of a condensable medium, a gaseous medium and a liquid.

5. A driving agent vacuum pump according to claim 1, wherein the driving agent is delivered into the evaporation chamber as a gas.

6. A driving agent vacuum pump according to claim 1, wherein the pumping chamber is provided with cooling.

7. A driving agent vacuum pump according to claim 6, wherein the cooling includes at least one of channels and cooling ribs.

8. A driving agent vacuum pump according to claim 6, wherein the cooling is formed by at least one Peltier element.

9. A driving agent vacuum pump according to claim 1, wherein the connection between the evaporation chamber and the pumping chamber is formed by one or more capillary channels.

10. A driving agent vacuum pump according to claim 9, wherein the evaporating chamber has a higher pressure than the pumping chamber to control the return flow of the driving agent through the capillary channels.

11. A driving agent vacuum pump according to claim 1, wherein a pressure sensor monitors the pumping function in the pumping chamber, said pressure sensor being located in at least one of the pump input, the pump output and in the evaporating chamber.

12. A driving agent vacuum pump according to claim 11, wherein the pressure sensor measures pressure using a Pirani arrangement.

13. A driving agent vacuum pump according to claim 1, further including a flow measurement device for determining the vacuum performance, the flow measurement device being provided in at least one of the vacuum intake region and the output region.

14. A driving agent vacuum pump according to claim 13, wherein the flow measurement is made using a heated wire principle.

15. A driving agent vacuum pump according to claim 1, further including at least one particle filter for reducing contamination, the particle filter being located in at least one of the jet supply channels, the evaporation chamber and the delivery and exhaust channels at the input and output.

16. A driving agent vacuum pump according to claim 1, wherein the two plates of the driving agent vacuum pump are comprised of three substrates.

17. A driving agent vacuum pump according to claim 16, wherein a middle substrate consists of a silicon substrate structured according to an anisotropic plasma etching method, and in that two side substrates are made of anodically bonded glass.

18. A driving agent vacuum pump according to claim 17, wherein the middle substrate is made of a galvanically finished metal structure.

19. A driving agent vacuum pump according to claim 18, wherein the middle substrate is galvanically washed onto a lower glass substrate and has an upper glass substrate as a closure.

20. A driving agent vacuum pump according to claim 1, further including a heater in a form of an electrically heated coil arranged in the evaporation chamber.

* * * * *